US006293600B1

(12) United States Patent
Lecourt

(10) Patent No.: US 6,293,600 B1
(45) Date of Patent: Sep. 25, 2001

(54) ARTICULATED RING FOR LIFTING LOADS

(75) Inventor: Marc Lecourt, Le Mans (FR)

(73) Assignee: S.H.B.L., Luxembourg (LU)

( * ) Notice: Subject to any disclaimer, the term of this patent is extended or adjusted under 35 U.S.C. 154(b) by 0 days.

(21) Appl. No.: 09/605,079

(22) Filed: Jun. 28, 2000

(30) Foreign Application Priority Data

Jul. 9, 1999 (EP) ..... 99630058

(51) Int. Cl.[7] ..... B66C 1/66

(52) U.S. Cl. ..... 294/1.1; 294/89; 403/78; 403/164

(58) Field of Search ..... 294/1.1, 82.1, 294/89; 403/78, 164; 410/101

(56) References Cited

U.S. PATENT DOCUMENTS 2,748,646 * 6/1956 Harold et al. ..... 294/89
4,570,987 * 2/1986 Wong et al. ..... 294/1.1
4,641,986 * 2/1987 Tsui et al. ..... 294/1.1
5,248,176 * 9/1993 Fredriksson ..... 294/89
5,405,210 * 4/1995 Tsui ..... 403/78

* cited by examiner

*Primary Examiner*—Dean J. Kramer
(74) *Attorney, Agent, or Firm*—Thomas S. Baker, J

(57) ABSTRACT

The invention relates to an articulated ring for lifting loads, specifically through the attachment of a ring or rings to the load in such a way that the longitudinal axis of the ring and the direction of lifting form an angle of 0 to 90 degrees between them, comprising an attachment stud (13) designed to be assembled with one extremity bolted to the load being lifted and a ring (11, 12) moveable with respect to the stud (13) at the other extremity of the stud (13), the stud (13) being an anchor bolt having a head. A bushing (15) is provided with a flange (16) at one extremity, the flange extremity (16) being, in the assembled state, distant from the head of the anchor bolt (13). An attachment (14, 31) to attach the ring (11, 12) is provided and adapted to be pushed onto the bushing (15) and to attach the ring (11, 12) moveably to the bolt (13) and maintain it in position in cooperation with the flange (16) of the bushing (15).

22 Claims, 2 Drawing Sheets

ARTICULATED RING FOR LIFTING LOADS

The present invention relates to an articulated ring for lifting loads, in particular through the attachment of a ring or rings to the load in such a way that the longitudinal axis of the ring and the lifting direction form an angle of between 0° and 90° between them.

Articulated lifting rings are known that comprise a ring equipped with two diametrically opposed lugs, connected to the free ends of a U-shaped ring in such a way that the ring swivels around the lugs. The ring turns around one end of a stud whose distal extremity is provided with threads with which the stem is screwed into a threaded hole in the load being lifted. The hole may be located on the upper surface of the load or on its side. These articulated rings have several disadvantages that could well be improved upon.

The object of the invention is to supply an articulated ring for lifting loads, in particular through attachment of a ring or rings to the load in such a way that the longitudinal axis of the ring and the direction of lifting form an angle of between 0° and 90°, which generally results in greater stability, fewer limitations regarding the material used for the ring, and greater ease of handling.

This object is realized by the articulated ring according to claim 1. Preferred embodiments are described in the dependent claims.

The proposed solution reduces the overhang at the point of attack of the lifting force when the articulated ring is used on the side of the load.

A non-limiting description of the invention, provided for illustrative purposes and represented in the attached drawings, is given below.

Figure 6B:
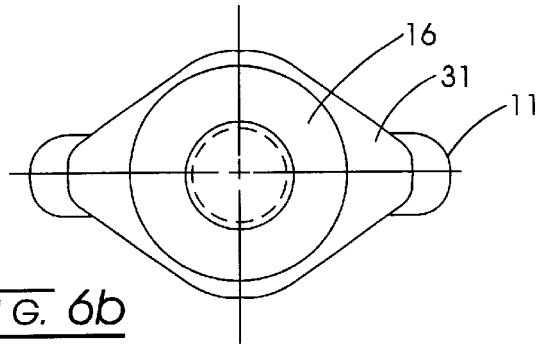
Figure 6A:
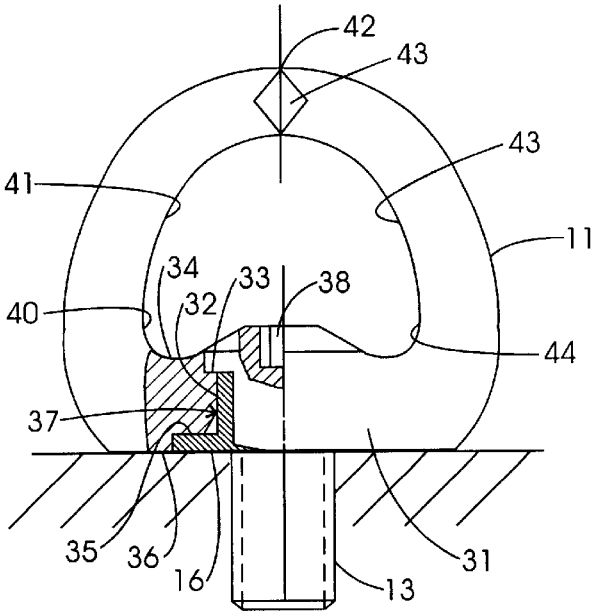
Figure 6C:
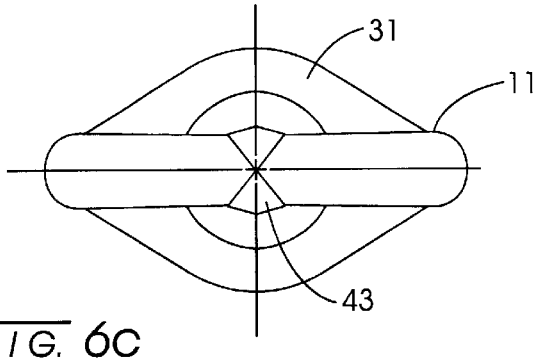

FIGS. 6*a*, 6*b*, and 6*c* represent three different views of another embodiment of the articulated ring according to the invention.

Figure 5:
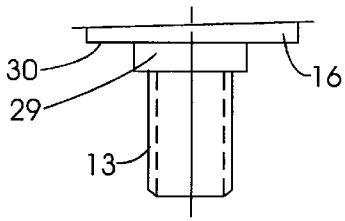
FIG. 5 represents an additional detail for the attachment of the articulated ring.
Figure 7:
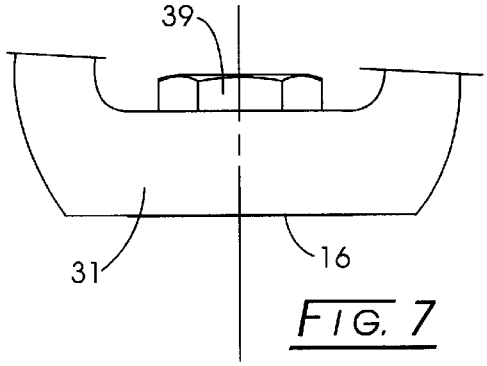
Figure 8:
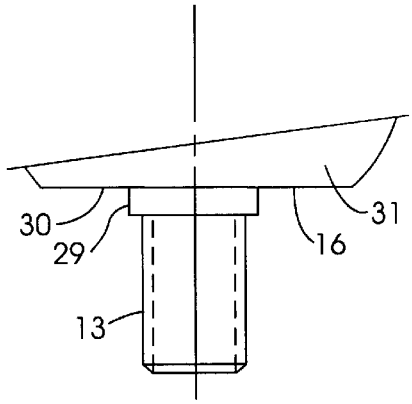

FIG. 7 represents a detail of the mode of embodiment of FIG. 6;

FIG. 8 represents a detail of the attachment of the articulated ring of FIG. 6 similar to that shown in FIG. 5.

Figure 1:
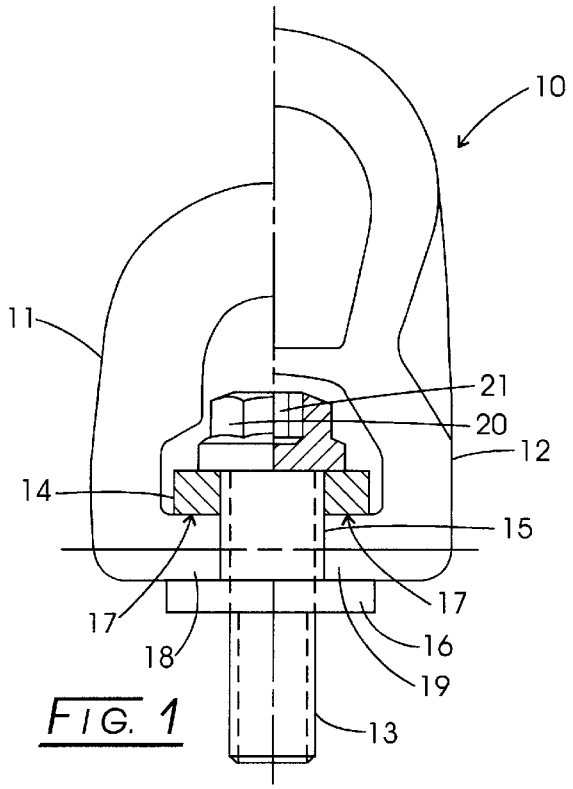
FIG. 1 is a partial cutaway view of an embodiment of the articulated ring according to the invention schematically illustrating two different usable rings.

In FIG. 1 an embodiment of articulated ring 10 according to the invention is shown with, as examples, two different ring halves, ring 11, an eye ring, and ring 12, a bar ring.

The articulated ring 10 comprises an anchor bolt or attachment stud 13 designed to be connected to a load by screwing one extremity to the load. A sleeve 14 is pushed onto bolt 13 and touches the head of bolt 13 with one of its extremities. A bushing 15 is pushed onto bolt 13 and screwed or shrunk-fit to it in such a way that in service position a flange 16, joined to bushing 15 at one of its extremities, is at a distance from the head of bolt 13. The interior dimensions of the sleeve and exterior dimensions of the bushing, as well as their lengths, are such that there is sufficient play for sleeve 14 to turn freely on bushing 15 mounted on bolt 13.

The articulated ring 10 also comprises a ring 11 or 12 that moves around said stud 13 at the other extremity of said stud 13.

Two diametrically opposed notches 17 are provided for in sleeve 14 at the extremity touching flange 16 when in service and designed to receive extremities 18 and 19 of ring 11 or 12 respectively. Articulated ring 11 or 12 is kept in place at its free extremities 18, 19 in notches 17 diametrically opposite sleeve 14 by flange 16 of bushing 15, said flange 16 being squeezed between the load and sleeve 14 by bolt 13, which is screwed in tightly.

The width of bar ring 12 is reduced near the bar in such a way that, starting at this point, the branches of ring 12 widen toward the summit of the ring. The result is that the hook of a hoisting sling used to lift the load at those locations where the branches of the ring widen, is displaced toward the summit of ring 12 and, at the same time, causes ring 12 to swivel around bolt 13 when ring 12 is mounted on the side of the load.

Bolt 13 can have six exterior faces 20 and/or six interior faces 21.

Figure 3:
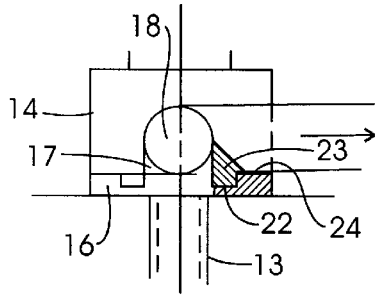
FIG. 3 represents a means of attaching the rings shown in FIG. 1.

FIG. 3 shows an improvement of bushing 15 and sleeve 14 assembly, in which a circular groove 22 is provided along the inside surface 24 of flange 16 of bushing 15, and a projection 23 corresponding to the groove is provided at the extremity of sleeve 14 containing notches 17. By means of this groove 22 and projection 23, sleeve 14 and bushing 15 are held together in the radial direction.

Figure 4:
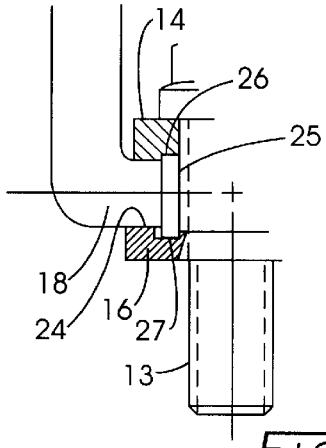
FIG. 4 represents another possible means of attaching the rings shown in FIG. 1.

FIG. 4 shows an improvement of the assembly of extremity 18 or 19 of the ring and sleeve 14. A retainer 25 is provided at each of the free extremities of rings 11 or 12 and is engaged in hollow 26 provided in the interior surface of sleeve 14 around notch 17 and circular groove 27 provided in the interior surface 24 of flange 16 of bushing 15. In this way ring 11 or 12 can not only swivel around its free extremities but also turn with sleeve 14 around bolt 13.

In FIG. 5 a centering device 29 is provided on the exterior 30 of flange 16 to facilitate centering of the articulated ring in a hollow provided for this purpose on the load.

Figure 2:
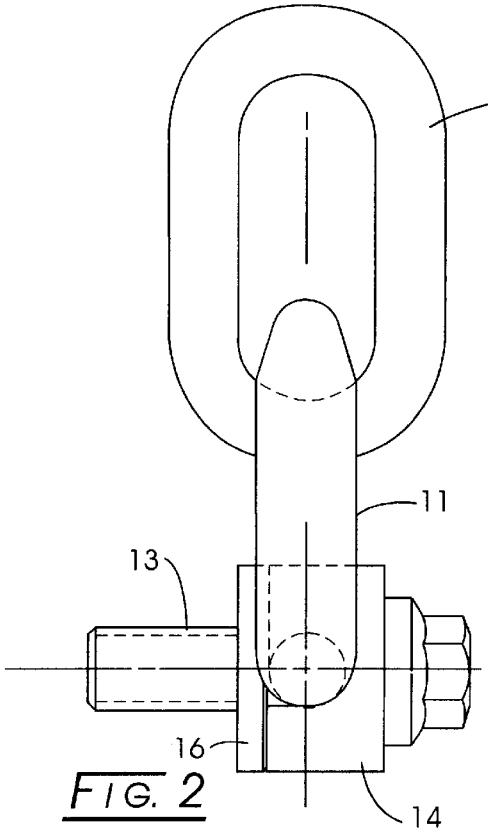
FIG. 2 represents an articulated ring according to FIG. 1 with an additional link.

In FIG. 2 a link of chain 31 is connected to ring 11 (or 12) with the result that, in the case of lateral attachment to a load, the bolt axis is located in a plane containing the plane of the link of chain 31 and the lifting sling hook used to lift the load is parallel to the lateral plane of the load to which the articulated ring is connected.

FIGS. 6*a*, 6*b*, and 6*c* show three different views of another embodiment of an articulated ring according to the invention. It comprises an anchor bolt 13 onto which a modified eye ring 11 has been fitted, as well as bushing 15, provided at one end with flange 16. Ring 11 comprises a flat sector 31 provided with a bore hole 32, designed in such a way that the head of bolt 13 fits into a hollow 33 in the upper surface 34 around bore hole 32, and flange 16 of bushing 15 into hollow 35 in its lower surface around bore hole 32, and bushing 15 into the center part 37 of bore hole 32. The longitudinal extensions of ring 31 of flange 16, of center part 37 and hollow 35, are such that the ring turns freely on bolt 13 when said bolt is screwed securely into the load being lifted, the play between the load and the lower surface 36 of flattened sector 31 being reduced to a minimum, thus allowing for free rotation of ring 11 with respect to the load.

Bolt 13 can have a flattened head with six interior faces 38 or a normal head with six exterior faces 39. In the case of the normal head, six interior faces 38 can be used alone or in combination with six exterior faces 39.

The shape of ring 11 outside flattened sector 31 is special in the sense that from the summit of the ring the interior perimeter widens in the direction of flattened sector 31 so that its maximum extension occurs at said flattened sector 31. The effect is such that when the articulated ring is mounted laterally on a load, the sling hook used to lift the load at positions 41 or 43 on ring 11 shifts toward positions 40 or 44 respectively on ring 11, while pulling on ring 11, which turns to position itself in the vertical direction, the position of ring 11 in FIGS. 6*a, b*, and *c* being horizontal.

At summit 42 in the middle of the ring a diamond-shaped bead 43 can be provided to facilitate movement of the sling hook toward one or the other side of bead 43 when lifting the load.

A centering device 29 can be provided on the lower side 30 of flange 16 to facilitate the centering of ring 11 during mounting, said centering device fitting into a corresponding hollow in the load to be lifted at the position where ring 11 is mounted.

What is claimed is:

1. An articulated ring for lifting loads, through attachment of a ring or rings to the load in such a way that the longitudinal axis of the ring and the lift direction form an angle of 0° to 90° between them, comprising an attachment stud (13) designed to be assembled with one extremity attached to a load in a threaded manner and a ring (11, 12), moveable with respect to said stud (13), at the other extremity of said stud (13), characterized in that said stud (13) is an anchor bolt having a head;

a bushing (15) is provided that can be shrink-fit or screwed onto said bolt (13) and equipped with a flange (16) at one extremity, the flange (16) extremity being, in its assembled state, distal from the head of the anchor bolt (13); and fixation means (14, 31) to fasten said ring (11, 12) is provided and adapted so it can be pushed onto said bushing (15) and fasten said ring (11, 12) moveably to said bolt (13) and maintain it in place in cooperation with said flange (16) of said bushing (15) wherein said fixation means (14, 31) touches said anchor bolt head in the assembled state.

2. Articulated ring for lifting loads according to claim 1, characterized in that said ring (11, 12) is a ring open at two free, opposed extremities (18, 19); and said fastening means (14, 31) of said ring (11, 12) is a sleeve (14) adapted to be pushed onto said bushing (15) and to receive the two extremities (18, 19) of said ring (11, 12) in order to maintain it in place in cooperation with said flange (16) of said bushing (15).

3. Articulated ring according to claim 2, characterized in that the extremity of said sleeve (14) touching said flange (16) is provided with two diametrically opposed notches (17) to accept a free extremity (18, 19) of said ring (11, 12).

4. Articulated ring according to claim 3, characterized in that the free extremities (18, 19) of said ring (11, 12) are each provided with a head (25) retained in a hollow (26) in the lower surface of the sleeve (14) around corresponding notch (17) and a circular groove (27) in the lower surface (24) of said flange.

5. Articulated ring according to claim 2 characterized in that there is a spline joint (23) and groove (22) between said flange (16) of said bushing and the extremity adjacent to said sleeve (14).

6. Articulated ring according to claim 2, characterized in that a centering device (29) is provided on the outer surface (30) of said flange (16).

7. Articulated ring according to claim 2 characterized in that said ring (11, 12) is an eye ring.

8. Articulated ring according to claim 2, characterized in that said ring (11, 12) is a bar ring whose inner edge is sloped.

9. Articulated ring according to claim 8, characterized in that the width of said ring (12) at the position of the bar is reduced in such a way that, from the point of attachment of said bar, the branches of said ring (12) widen toward the summit of said ring.

10. Articulated ring according to claim 2, characterized in that the head of said bolt (13) has six outside faces (20).

11. Articulated ring according to claim 2, characterized in that the head of said bolt (13) has six inside faces (21).

12. Articulated ring according to claim 1, characterized in that there is a chain link (31) that cooperates with said moveable ring (11, 12), the axis of said stud (13) being within the plane of said link (31).

13. Articulated ring according to claim 1, characterized in that said fixation means (14, 31) is formed by a flattened sector (31) of said ring (11) provided with a bore hole (32) designed to be pushed onto said bushing (15) and equipped with corresponding hollows (33, 35) around the extremities of said bore hole (32) to receive either said flange (16) or said head in such a way as to afford rotation about said bushing (15) when the articulated ring and load are assembled.

14. Articulated ring according to claim 13, characterized in that there is a diamond-shaped bead (43) in the middle of said ring.

15. Articulated ring according to claim 13, characterized in that said head has six exterior faces (39).

16. Articulated ring according to claim 13, characterized in that there is a centering device (29) on the exterior (30) of said flange (16).

17. Articulated ring according to claim 13, characterized in that said ring (11) is an eye ring whose interior perimeter widens from the summit of the eye in the direction of said flattened sector (31), with its maximum extension at the location of said flattened sector (31).

18. Articulated ring according to claim 13, characterized in that said head has six interior faces (38).

19. An articulated ring assembly for lifting load comprising:

an anchor bolt having a threaded portion and a head;

a flanged bushing which overlies and is rigidly affixed to said threaded bolt portion adjacent said head and wherein said flanged bushing has a flange distal from the head of the anchor bolt;

a bored sleeve which overlies said bushing positioned adjacent said anchor bolt head wherein said sleeve is rotatable about said bushing; and a ring having a pair of extremities secured between said rotatable sleeve and said fixed bushing flange such that said ring is fixedly rotatable about the longitudinal axis of said anchor bolt and is pivotal from 0° to 90° about an axis perpendicular to the longitudinal axis of said anchor bolt to enable said ring to be secured to the top of a load or to a lateral side of a load.

20. The articulated ring of claim 19 characterized in that a pair of diametrically opposed notches are formed in the extremity of said sleeve adjacent said flange;

each said notches adapted to receive an extremity of said ring.

21. The articulated ring of claim 19 further characterized by a cylindrical centering element mounted on said anchor bolt adjacent said bushing flange.

22. The articulated ring of claim 19 wherein an enlarged head is formed on each of said ring extremities;

a first groove is formed in a surface on said flange;

a second groove is formed in a surface on said sleeve facing said first groove; and said heads of said ring extremities are retained in said first and second grooves.

* * * * *